United States Patent [19]

Imberti

[11] 3,938,791

[45] Feb. 17, 1976

[54] DEVICE FOR PLUGGING TAP-HOLES OF REACTORS FOR METALLURGICAL PROCESSES

[75] Inventor: Bruno Imberti, Genova, Italy

[73] Assignee: Centro Sperimentale Metallurgico S.p.A., Rome, Italy

[22] Filed: Jan. 14, 1975

[21] Appl. No.: 540,868

Related U.S. Application Data

[63] Continuation of Ser. No. 378,994, July 13, 1973, abandoned.

[30] Foreign Application Priority Data

July 31, 1972 Italy ..... 51891/72

[52] U.S. Cl. ..... 266/42

[51] Int. Cl.[2] ..... C21C 5/46

[58] Field of Search ..... 266/42, 38

[56] References Cited

UNITED STATES PATENTS

| | | | |
|---|---|---|---|
| 673,556 | 5/1901 | Hartman | 266/42 |
| 796,325 | 8/1905 | Hall | 266/42 |
| 1,537,901 | 5/1925 | Tharaldsen | 266/42 |
| 3,084,925 | 4/1963 | Stauffer et al. | 266/42 |
| 3,400,859 | 9/1968 | Thaker et al. | 266/42 |
| 3,589,699 | 6/1971 | Bogan | 266/42 |
| 3,599,953 | 8/1971 | Smith | 266/42 |

*Primary Examiner*—Gerald A. Dost

*Attorney, Agent, or Firm*—Young & Thompson

[57] ABSTRACT

A device for plugging the taphole in reactors for metallurgical processes in which the plug includes: a solid element, made of refractory material, which expands in a substantially cylindrical head having a diameter greater than that of the tap-hole, and applied to the solid element, and O-ring packing made of a material consisting essentially of a mixture of a refractory material in powder form and of a binder, said material being cold coherent, plastically deformable for increasing values of the temperature within the limits of the thermal interval within which the mixture sets, and becoming indeformable for values of the temperature higher than the said thermal setting interval, but lower than the operating temperature of the reactor, after a period of exposure to the operative conditions longer than the time necessary for installing the plug.

1 Claim, 3 Drawing Figures

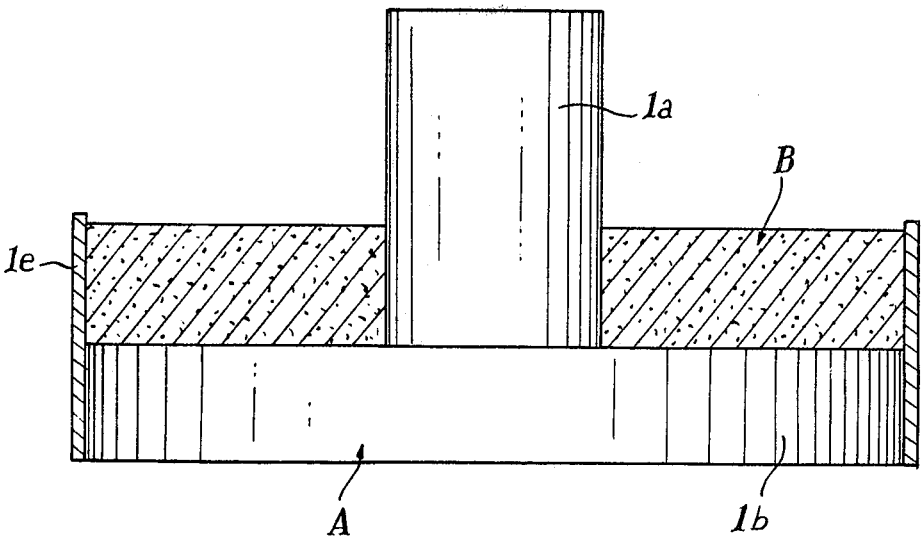
Fig. 1
Fig. 2
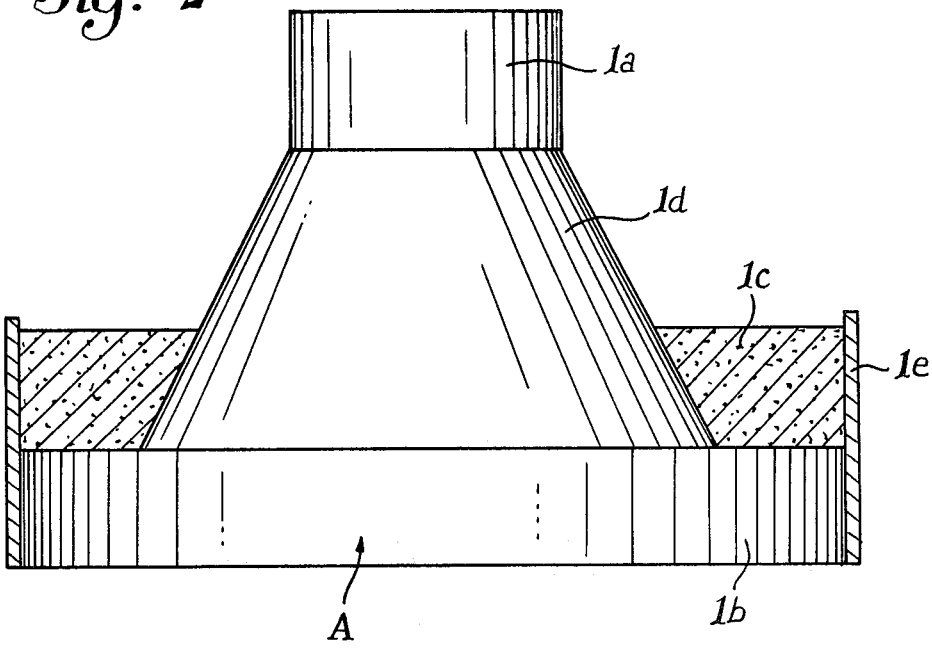

DEVICE FOR PLUGGING TAP-HOLES OF REACTORS FOR METALLURGICAL PROCESSES

This is a continuation of application Ser. No. 378,994, filed July 13, 1973, and now abandoned.

The present invention relates to a device for plugging the tapholes in reactors for metallurgical processes. Particularly for completing and improving the invention disclosed in U.S. Pat. No. 3,776,532. The present invention provides further technical improvements in order to improve the technical result attained by the invention described in said patent.

The use of the device according to the cited patent has certain drawbacks.

The first drawback is that of being unable to avoid losses, even if of small amount, of the material contained within the reactor, due to an imperfect mating of the plug (renewed at each tapping, and therefore provided with an even lateral surface) and the contour of the taphole which will be on the contrary worn and therefore showing an irregular shape due to the erosion caused by the flow of the steel and of the slag during the preceding tappings The improved device accordng to the present invention allows said primary drawback to be overcome, through an improved sealing action.

Other advantages inherent to the use of the improved device are: an improved adhesion of the plug to the tap-hole and an easier removal of the plug after its use.

All these advantages are consequent to an embodiment of the plug for the taphole according to a modified constructive principle, which provides for the use of an intermediate element connecting the hole to the plug, according to a solution which represents a technical improvement with respect to the solution disclosed in the cited patent.

Said intermediate element, which consists of a mixture of refractory powder with a binder, has a shape which is technologically suitable to serve the function of sealant packing.

The most important features of the mixture are:

— A sufficient cold cohesion, so as not to deform and to disjoin during the normal handling operations, including those for inserting the plug in the taphole;

— to be plastically deformable for increasing values of the temperature within the limits of the thermal interval between which the mixture hardens;

— to be indeformable, having refractory characteristics, above said thermal interval, due to an occurred chemical and/or ceramic setting and/or due to transformations of either the binder and/or the base.

Another advantage of said mixture is that of having a low strength against dynamic impact due to the chemical and/or ceramic setting and/or to the transformations of the binder and/or the base.

When the plug, provided with the cited packing is pressed against the taphole, the packing, which contacts the hot walls of the reactor, will deform so as to seal the possible surface irregularities of the orifice of the tap-hole. Immediately after, due to the effect of the further increase of the temperature, the packing will harden, becoming indeformable, so that the plug and the tap-hole will be permanently connected. When the tap-hole is to be opened, the plug will be easily removed due to the weak strength against dynamic impact presented by the packing after its hardening.

The improvement forming the subject matter of this invention will be now described, only by way of non limitative example, with reference to the attached drawings showing preferred embodiments thereof.

Particularly, in the drawins:

FIG. 1 shows a vertical section view of a first embodiment of the plug according to the present invention;

FIG. 2 shows a vertical section view of another embodiment of said plug; and

Figure 3:
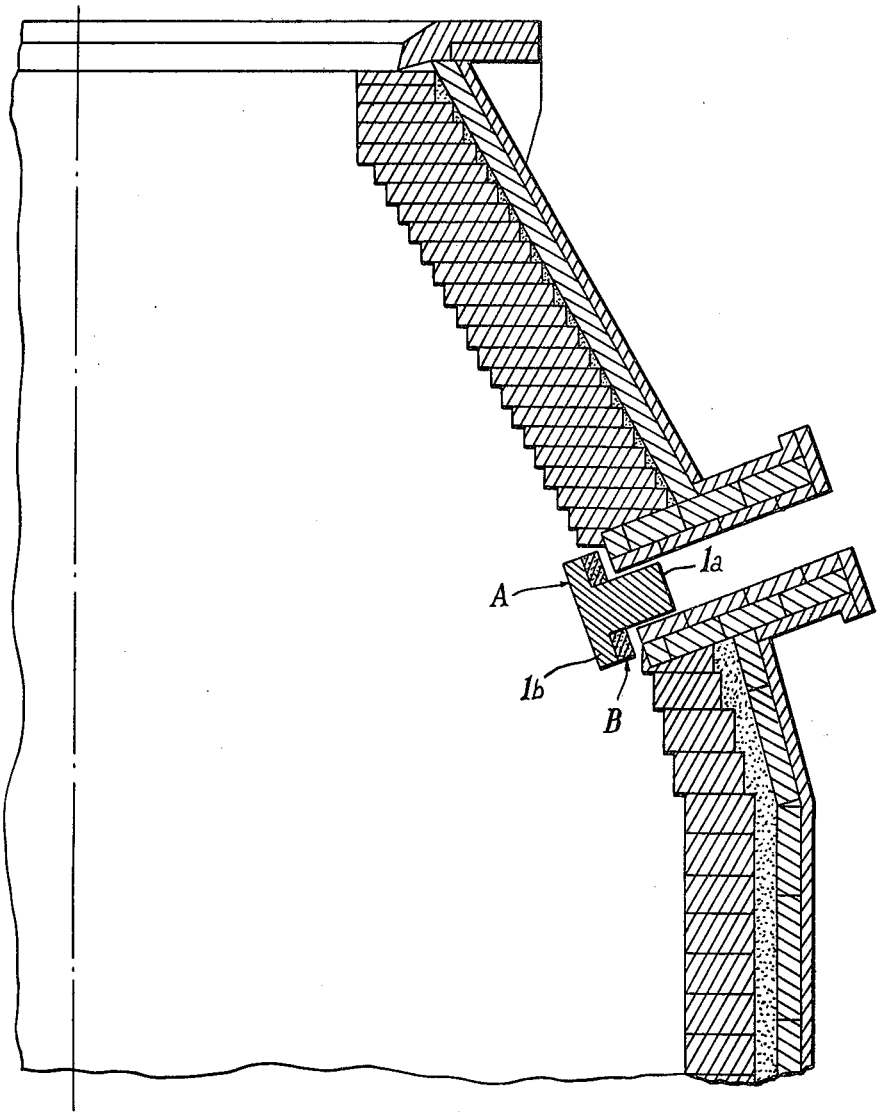
FIG. 3 shows a cross-sectional view of a metallurgical reactor with a plug according to the present invention in place therein.

With reference to both said FIGS. 1 and 2, the plug is formed of two parts and specifically: a solid element (A) of refractory material, and a ring packing (B) or 1*c*, made of said mixture material (refractory powder and binder).

The solid element (A) has a composite shape, with a cylindrical base 1*a* having a diameter smaller than that of the taphole, so as to allow the solid element to be introduced into the tap-hole. Said base 1*a* widens, at its end facing the inside of the reactor, to a cylindrical head 1*b* the base of which has a diameter greater than that of the tap-hole (see FIGS. 1).

The cited solid element (A) can also have a more complicated shape wherein the two cylindrical parts: base 1*a* and head 1*b* are connected by a frusto conical element 1*d* (see FIGS. 2).

The annular packing 1*c* can be pre-fabricated independently from the solid element (A) or it can be directly formed by casting on said solid element (A) utilizing a collar member 1*e* which surrounds the cylindrical head 1*b*. The part of said collar member 1*e* projecting through a certain height towards the smaller sectioned end of the solid element (A) serves the function of preventing the material forming the packing from flowing before the plug is installed.

In both cases the collar member 1*e* can serve the same containment function also while the plug is being installed, preventing any possible radial outflow of the material forming the packing.

As aforesaid, the collar member can be made of metal sheet or of any other plastically deformable material, while the packing consists of a mixture of a refractory material and a binder in suitable proportions.

The compositions which have been found to be preferable for preparing said mixture, indicated in percentage by weight are the following:

| | percent by weight |
|---|---|
| Magnesite, grain size $\leqslant$ 3 mm | 75 – 95 |
| Dry pitch in powder form | 0 – 12 |
| Tar | 2 – 10 |

In a particularly preferable composition the percents by weight as hereinafter reported have been used:

| | percent by weight |
|---|---|
| Magnesite, grain size < 1 mm | 52.18 |
| Magnesite, grain size $\geqslant$ 1 mm < 2 mm | 21.74 |
| Magnesite, grain size $\geqslant$ 2 mm < 3 mm | 13.04 |
| Dry pitch in powder form | 9.13 |
| Tar | 3.91 |

It is important to remark that the improvement according to this invention renders the plugging device useful also for stationary reactors; for instance in those reactors where iron or steelmaking oxygen top-blown processes are carried out.

In fact, like in the rotating and/or oscillating reactors, also in the cited stationary reactors it occurs that, due to the slag becoming emulsified, to stirring and other unforeseeable reasons, the projection and the escape of liquid materials occur through the taphole, even if said tap-hole is at a level even much higher than that of the bath, with the consequence that the following drawbacks occur:

— losses of metal and/or slag;
— heavy wear of the refractory material forming the wall of the taphole due to chemical etching of the slag, and
— possibility of clogging, even if partial, of the taphole due to solidification of the projected material inside the hole.

The improved plug forming the subject matter of the present invention is suitable particularly to solve the cited problems also in case of stationary reactors. In fact, the setting or hardening of the connecting material forming the packing in each case ensures the additional adhesion of the plug (necessary to avoid the effects of an unpredictable breakage of the plug locking members) to the taphole, said adhesion, in case of the technical solution envisaged for the rotating and/or oscillating reactors in the cited patent, being on the contrary ensured by centrifugal force.

The present invention has been described with particular reference to certain specific embodiments thereof, it however understood that changes and variations might be made therein, without thereby departing from the scope of the present invention.

Having thus described the present invention, what is claimed is:

1. A device for plugging the taphole from within reactors for metallurgical processes, comprising a solid element made of refractory material and having an enlarged substantially cylindrical head, an annular packing consisting essentially of a mixture of refractory material in powder form and of a binder, said packing being disposed on the same side of said head as said element and surrounding one end of said element, said material being cold coherent and plastically deformable for increasing values of the temperature within the limits of the thermal interval within which the mixture sets, and becoming indeformable for values of the temperature higher than the said thermal setting interval, but lower than the operating temperature of the reactor, after a period of exposure to the operative conditions longer than the time necessary for installing the plug, and an annular collar member made of sheet material and surrounding said annular packing and spaced outwardly from said solid element by said annular packing.

* * * * *